US007921649B2

(12) United States Patent
Lehtinen et al.

(10) Patent No.: US 7,921,649 B2
(45) Date of Patent: Apr. 12, 2011

(54) MODE SUPPRESSION SHAPE FOR BEAMS

(75) Inventors: Jeffrey Lehtinen, Concord Township, OH (US); Fady Bishara, Geneva, NY (US)

(73) Assignee: Parker-Hannifin Corporation, Cleveland, OH (US)

( * ) Notice: Subject to any disclaimer, the term of this patent is extended or adjusted under 35 U.S.C. 154(b) by 1297 days.

(21) Appl. No.: 11/459,172

(22) Filed: Jul. 21, 2006

(65) Prior Publication Data

US 2007/0039325 A1 Feb. 22, 2007

Related U.S. Application Data

(60) Provisional application No. 60/701,284, filed on Jul. 21, 2005.

(51) Int. Cl.
*F02C 1/00* (2006.01)

(52) U.S. Cl. ..... 60/740; 60/772

(58) Field of Classification Search ..... 60/725, 60/740, 772, 776; 29/890.02; 216/16
See application file for complete search history.

(56) References Cited

U.S. PATENT DOCUMENTS 4,823,614 A 4/1989 Dahlin
5,404,711 A * 4/1995 Rajput ..... 60/39.463
5,435,884 A 7/1995 Simmons et al.
5,465,907 A 11/1995 Hofmann
6,038,862 A 3/2000 Melman et al.
6,076,356 A * 6/2000 Pelletier ..... 60/740
6,092,429 A 7/2000 Cunningham et al.
6,098,407 A 8/2000 Korzendorfer et al.
6,321,541 B1 11/2001 Wrubel et al.
6,523,350 B1 * 2/2003 Mancini et al. ..... 60/740
6,711,898 B2 3/2004 Laing et al.
6,718,770 B2 4/2004 Laing et al.
6,886,346 B2 5/2005 Sobieski et al.
2002/0104288 A1 8/2002 O'Sullivan et al.
2002/0189259 A1 * 12/2002 Laing et al. ..... 60/740

* cited by examiner

*Primary Examiner* — Michael Cuff
*Assistant Examiner* — Phutthiwat Wongwian
(74) *Attorney, Agent, or Firm* — Renner, Otto, Boisselle & Sklar, LLP

(57) ABSTRACT

A method for increasing and/or suppressing a natural frequency of a fuel injector feed strip while increasing in the axial direction the flexibility of the feed strip, without the use of additional structure or damping devices. More particularly, and by way of example, the present invention provides a fuel feed strip that is shaped in a shape corresponding to a first vibration mode (e.g., a bow shape) of a fuel feed strip of a desired shape (e.g., a straight fuel feed strip). By forming the fuel feed strip in a shape corresponding to a first vibration mode of the fuel feed strip of a desired shape, a vibration mode of the fuel feed strip is suppressed while the axial flexibility of the fuel feed strip is increased.

3 Claims, 7 Drawing Sheets

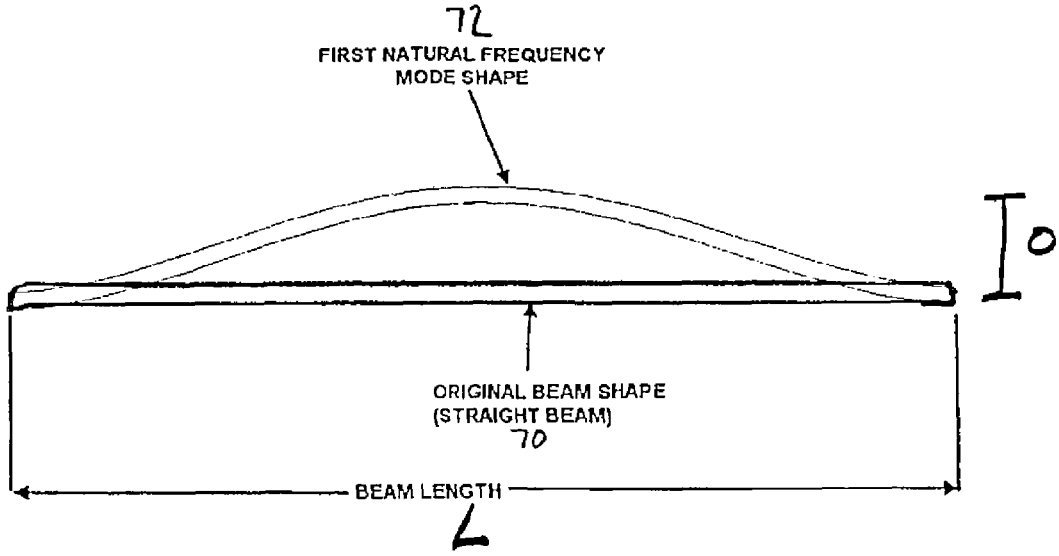
Fig. 6 Straight Beam
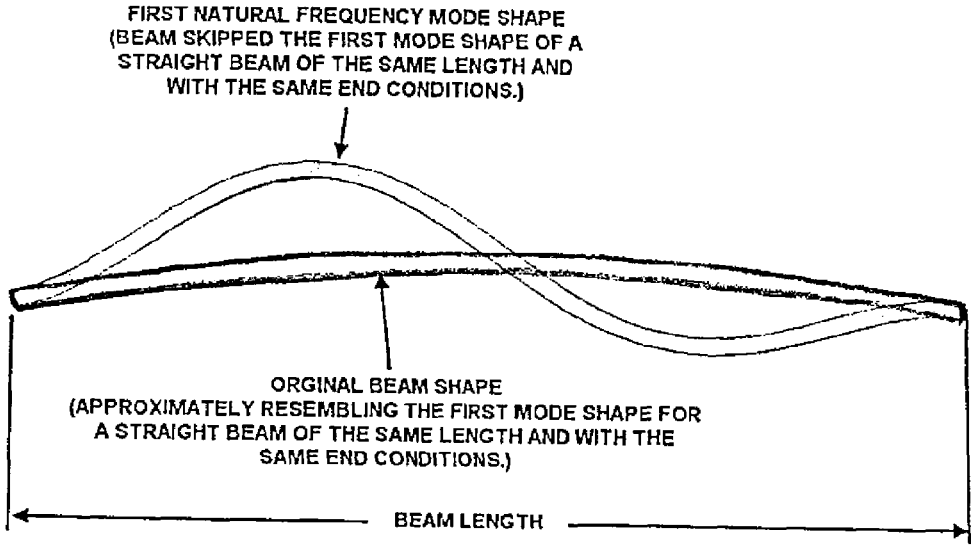
Fig. 7 Bowed Beam

MODE SUPPRESSION SHAPE FOR BEAMS

RELATED APPLICATION

This application hereby incorporates by reference and claims the benefit of U.S. Provisional Application No. 60/701,284 filed Jul. 21, 2005.

FIELD OF THE INVENTION

The present invention relates generally to fuel injectors. More particularly, the invention relates to fuel injectors for use with gas turbine combustion engines.

BACKGROUND OF THE INVENTION

A gas turbine engine contains a compressor in fluid communication with a combustion system that often contains a plurality of combustors. The compressor raises the pressure of the air passing through each stage of the compressor and directs it to the combustors where fuel is injected and mixed with the compressed air. The fuel and air mixture ignites and combusts creating a flow of hot gases that are then directed into the turbine. The hot gases drive the turbine, which in turn drives the compressor, and for electrical generation purposes, can also drive a generator.

Most combustion systems utilize a plurality of fuel injectors for staging, emissions purposes, and flame stability. Fuel injectors for applications such as gas turbine combustion engines direct pressurized fuel from a manifold to the one or more combustion chambers. Fuel injectors also function to prepare the fuel for mixing with air prior to combustion. Each fuel injector typically has an inlet fitting connected either directly or via tubing to the manifold, a tubular extension or stem connected at one end to the fitting, and one or more spray nozzles connected to the other end of the stem for directing the fuel into the combustion chamber. A fuel passage (e.g., a tube or cylindrical passage) extends through the stem to supply the fuel from the inlet fitting to the nozzle. Appropriate valves and/or flow dividers can be provided to direct and control the flow of fuel through the nozzle and/or fuel passage.

U.S. Pat. No. 6,718,770 to Laing et al. discloses a gas turbine fuel injector including a single feed strip (fuel passage) contained in a hollow stem of the injector. In one embodiment, the feed strip includes a curved middle portion with a radius of curvature greater than a length of the middle portion so that the strip can be easily inserted and withdrawn from the hollow stem without placing undue stress on the strip.

The fuel injectors are often placed in an evenly-spaced annular arrangement to dispense (spray) fuel in a uniform manner into a combustor. Additional concentric and/or series combustion chambers each require their own arrangements of nozzles that can be supported separately or on common stems. The fuel provided by the injectors is mixed with air and ignited, so that the expanding gases of combustion can, for example, move rapidly across and rotate turbine blades to power an aircraft.

Of particular concern in the design of any component of a gas turbine engine is high cycle fatigue. High cycle fatigue in turbine engines occurs when resonance or vibration modes of parts like fuel injectors, turbine blades, compressors, or rotors are excited by driving frequencies inherent in the operation of the engine. For example, shaft rotation imbalance can produce driving frequencies between about 200 to about 300 Hertz (Hz). Driving frequencies due to combustion rumble can be in the range of about 300 Hz to about 800 Hz. Fuel pump pulsations can produce driving frequencies in the range of 1200 Hz. Blade passing frequencies can be upwards of 1200 Hz.

Prior art fuel injectors have incorporated devices, such as the one shown in U.S. Pat. No. 6,038,862, to address the issue of high cycle fatigue. Typically, such devices are intended to damp vibration of the parts to avoid resonance. However, such devices can be complex and require additional parts which can resonate themselves. Another approach has been to alter the natural frequency, also referred to herein as resonant frequency, of the parts. In general, reinforcing ribs and/or additional structure is provided to increase the natural frequency of the part above the anticipated driving frequencies of the turbine.

Another approach has been to alter the natural frequency of the part by shaping the part such that its natural frequency is above the maximum driving frequency the part will experience. For example, U.S. Pat. No. 6,098,407 discloses a fuel injector including a fuel supply tube that is coiled into a 360 degree spiral shape. Ideally, the curvature of the tube is such that the tube's natural frequency is well above the maximum vibratory frequency that the tube will experience during engine operation.

The above-described approaches for dealing with high-cycle fatigue, although effective for many applications, tend to add bulk to the parts which can take up valuable space in and around the combustion chamber, block air flow to the combustor, and add weight to the engine. Additional structure also tends to increase the stiffness of the parts which can be undesirable in applications where flexibility of the part is desired or necessary. This can all be undesirable with current industry demands requiring reduced cost, smaller injector size, and reduced weight for more efficient operation.

SUMMARY OF THE INVENTION

The present invention provides a method for increasing and/or suppressing a natural frequency of a fuel injector feed strip while increasing in the axial direction the flexibility of the feed strip, without the use of additional structure or damping devices. More particularly, and by way of example, the present invention provides a fuel feed strip that is shaped in a shape corresponding to a first vibration mode (e.g., a bow shape) of a fuel feed strip of a desired shape (e.g., a straight fuel feed strip). By forming the fuel feed strip in a shape corresponding to a first vibration mode of the fuel feed strip of a desired shape, a vibration mode of the fuel feed strip is suppressed while the axial flexibility of the fuel feed strip is increased. A similar effect can be achieved by shaping the fuel feed strip into a shape corresponding to other vibration modes (e.g., second, third, etc.) of the fuel feed strip of a desired shape.

Accordingly, the invention provides a method to increase and/or suppress a natural frequency of a component or part, while also increasing axial flexibility of the component or part, without additional structure. Axial flexibility is desirable in many applications for compensating for differences in thermal growth between the component, for example a fuel feed strip, and adjacent structure, for example the stem or housing in which the fuel feed strip is supported.

In accordance with an aspect of the present invention, a method of increasing a natural frequency of a fuel feed strip of a fuel injector of a turbine comprises determining a vibration mode shape corresponding to a first natural frequency of a fuel feed strip of a desired shape, and shaping the fuel feed strip into a shape approximating the determined vibration mode shape. The first natural frequency of the shaped fuel feed strip will generally correspond to the second natural frequency of the fuel strip of a desired shape, and the axially flexibility of the shaped fuel feed strip will be greater than the axial flexibility of the fuel feed strip of a desired shape. The vibration mode shape can be a bow shape corresponding to the first natural frequency of the feed strip of a desired shape.

In accordance with another aspect of the invention, a method of suppressing a vibration mode of a fuel feed strip for a fuel injector of a turbine comprises determining a vibration mode shape of a fuel feed strip of a desired shape, and shaping the fuel feed strip into a shape approximating the determined vibration mode shape. The method can further comprise determining a natural frequency to be avoided, wherein the determining a vibration mode shape includes determining a vibration mode shape of the fuel feed strip of a desired shape corresponding to the natural frequency to be avoided, and wherein the shaping includes shaping the fuel feed strip into a shape approximating the determined vibration mode shape.

According to still another aspect of the invention, a fuel feed strip for a fuel injector of a turbine has a shape generally approximating a vibration mode shape of a fuel feed strip of a desired shape, wherein the axial flexibility of the fuel feed strip is greater than the axial flexibility of the fuel feed strip of a desired shape.

Further features of the invention will become apparent from the following detailed description when considered in conjunction with the drawings.

BRIEF DESCRIPTION OF THE DRAWINGS

FIG. 6 is a graph illustrating a first natural frequency vibration mode shape of an unshaped (straight) beam.

FIG. 7 is a graph illustrating a first natural frequency vibration mode shape of a beam having a shape generally corresponding to the first vibration mode shape of the beam in FIG. 6.

DETAILED DESCRIPTION

Figure 1:
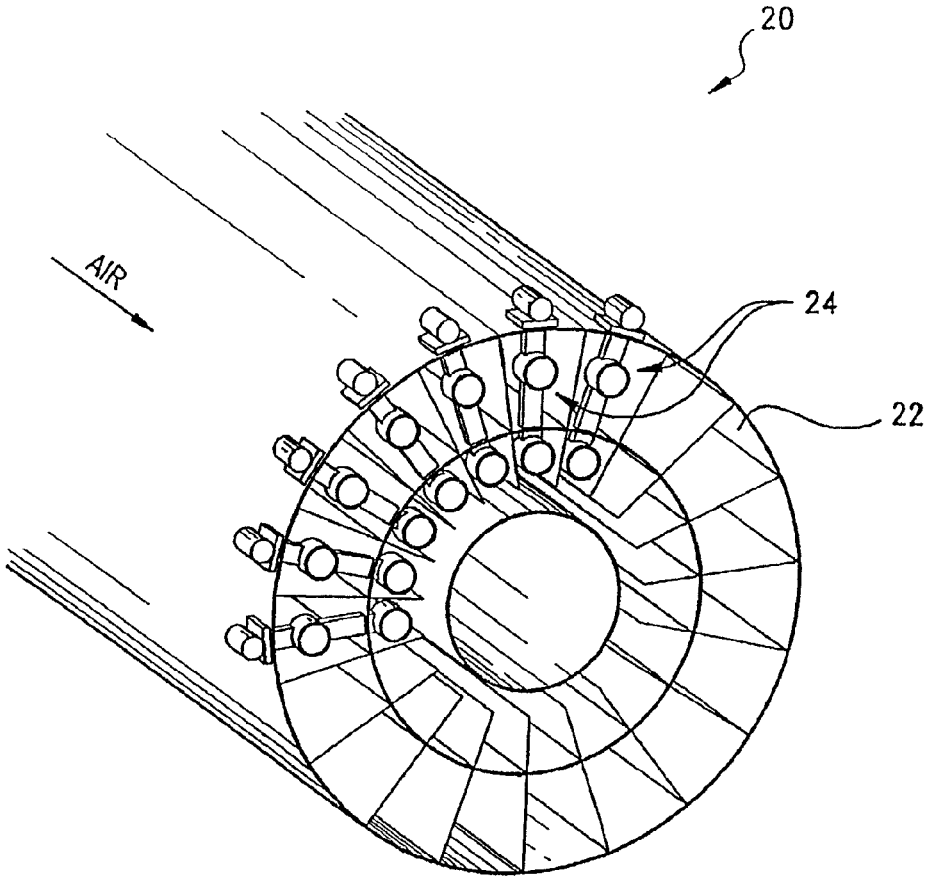
FIG. 1 PRIOR ART
FIG. 1 is a perspective view of the inlet into a dual concentric combustion chamber for a gas turbine engine including a fuel injector assembly according to the prior art.

Referring to the drawings and initially to FIG. 1, a portion of a known combustion engine is indicated generally at 20. The upstream, front wall of a dual combustion chamber for the engine is shown at 22, and a plurality of fuel injectors, for example as indicated generally at 24, are shown supported within the combustion chamber. The fuel injectors 24 atomize and direct fuel into the combustion chamber 22 for burning. Combustion chamber 22 can be any useful type of combustion chamber, such as a combustion chamber for a gas turbine combustion engine of an aircraft, however, the present invention is believed useful for combustion chambers for any type of combustion application, such as in land vehicles. In any case, the combustion chamber will not be described herein for sake of brevity, with the exception that as should be known to those skilled in the art, air at elevated temperatures (up to 1300.degree. F. in the combustion chamber of an aircraft), is directed into the combustion chamber to allow combustion of the fuel.

As illustrated in FIG. 1, a dual nozzle arrangement for each injector is shown, where each of the fuel injectors 24 includes two nozzle assemblies for directing fuel into radially inner and outer zones of the combustion chamber. It should be noted that this multiple nozzle arrangement is only provided for exemplary purposes, and the present invention is useful with a single nozzle assembly, as well as injectors having more than two nozzle assemblies in a concentric or series configuration. It should also be noted that while a number of such injectors are shown in an evenly-spaced annular arrangement, the number and location of such injectors can vary, depending upon the particular application. One of the advantages of the present invention it is that is useful with a variety of different injector configurations.

Figure 2:
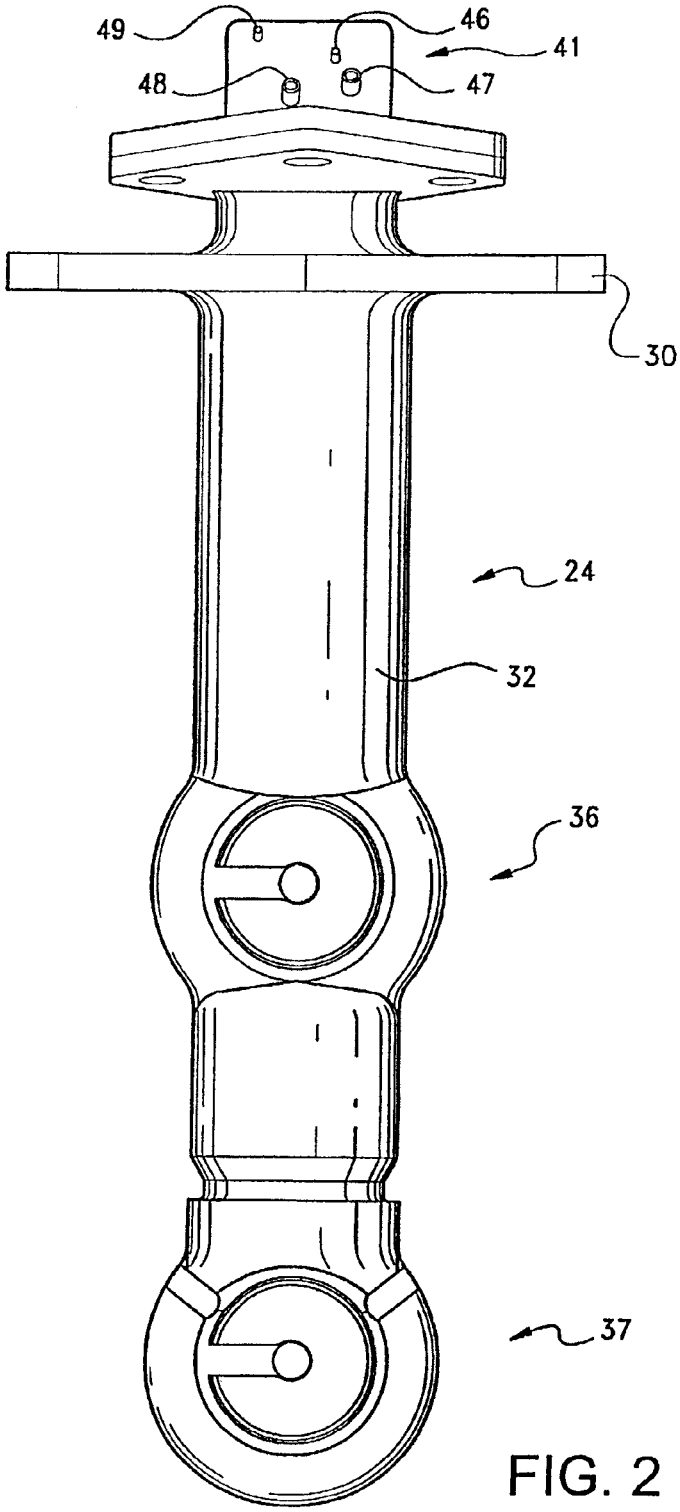
FIG. 2 PRIOR ART
FIG. 2 is a perspective view of a fuel injector for the engine of FIG. 1.
Figure 3:
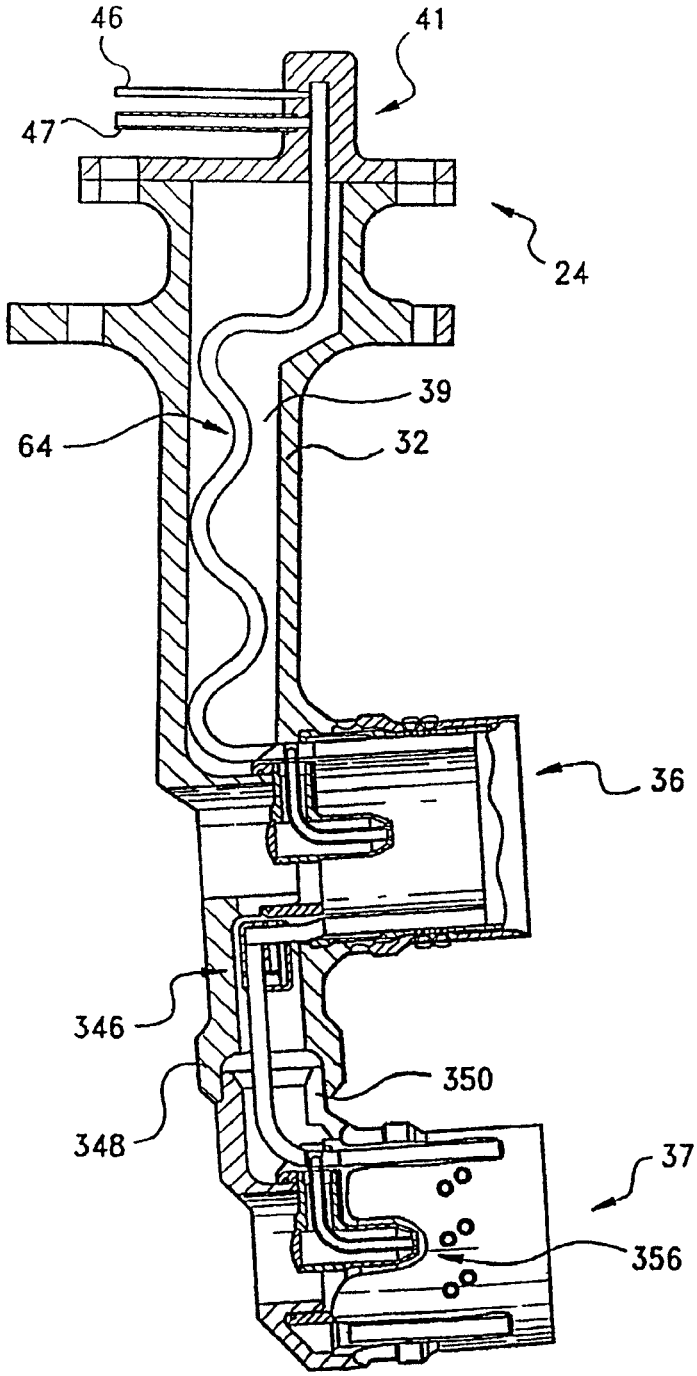
FIG. 3 PRIOR ART
FIG. 3 is a cross-sectional view of the fuel injector of FIG. 2.

Referring now to FIGS. 2 and 3, each fuel injector 24, which are typically identical, includes a nozzle mount or flange 30 adapted to be fixed and sealed to the wall of the combustor casing (such as with appropriate fasteners); a housing stem 32 integral or fixed to flange 30 (such as by brazing or welding); and one or more nozzle assemblies such as at 36, 37, supported on stem 32. Stem 32 is generally cylindrical and includes an open inner chamber 39. The various components of the fuel injector 24 are preferably formed from material appropriate for the particular application as should be known to those skilled in the art.

An inlet assembly, indicated generally at 41, is disposed above or within the open upper end of chamber 39, and is integral with or fixed to flange 30 such as by brazing. Inlet assembly 41 is also formed from material appropriate for the particular application and includes inlet ports 46-49 which are designed to fluidly connect with a fuel manifold (not shown) to direct fuel into the injector 24.

Each of the nozzle assemblies 36, 37 is illustrated as including a pilot nozzle, indicated generally at 58, and a secondary nozzle, indicated generally at 59. Both nozzles 58, 59 are generally used during normal and extreme power situations, while only pilot nozzle 58 is generally used during start-up. Again, a pilot and secondary nozzle configuration is shown only for exemplary purposes, and it is within the scope of the present invention to provide only a single nozzle for each nozzle assembly 36, 37, or more than two nozzles for each nozzle assembly.

An elongated fuel feed strip, indicated generally at 64, provides fuel from inlet assembly 41 to nozzle assemblies 36, 37. Feed strip 64 is an expandable feed strip formed from a material which can be exposed to combustor temperatures in the combustion chamber without being adversely affected. To this end, feed strip 64 has a convoluted (or tortuous) shape and includes a plurality of laterally-extending, regular or irregular bends or waves as at 65, along the longitudinal length of the strip from inlet end 66 to outlet end 69 to allows for expansion and contraction of the feed strip in response to thermal changes in the combustion chamber while reducing mechanical stresses within the injector. Although the convolutions allow expansion of the feed strip 64, they also tend to reduce the natural frequency of the feed strip 64.

By the term "strip", it is meant that the feed strip has an elongated, essentially flat shape (in cross-section), where the side surfaces of the strip are essentially parallel, and oppositely facing from each other; and the essentially perpendicular edges of the strip are also essentially parallel and oppositely-facing. The strip 64 has essentially a rectangular shape in cross-section (as compared to the cylindrical shape of a typical fuel tube), although this shape could vary slightly depending upon manufacturing requirements and techniques. The strip 64 is shown as having its side surfaces substantially perpendicular to the direction of air flow through the combustion chamber. This may block some air flow through the combustor, and in appropriate applications, the strip 64 may be aligned in the direction of air flow.

Feed strip 64 includes a plurality of inlet ports, where each port fluidly connects with inlet ports 46-49 in inlet assembly 41 to direct fuel into the feed strip 64. The inlet ports 46-49 feed multiple fuel paths down the length of the strip 64 to pilot nozzles 58 and secondary nozzles 59 in both nozzle assemblies 36, 37, as well as provide cooling circuits for thermal control in both nozzle assemblies. For ease of manufacture and assembly, the feed strip 64 and secondary nozzle 59 can be integrally connected to each other, and preferably formed unitarily with one another, to define a fuel feed strip and nozzle unit.

The fuel combustion chamber and prior art fuel injectors described in FIGS. 1-3 are further described in commonly-assigned U.S. Pat. No. 6,711,898, which is hereby incorporated by reference herein in its entirety. Although these fuel injectors are adequate for use in many applications, the convoluted fuel feed strip 64 can be subject to resonance in certain applications.

Figure 4:
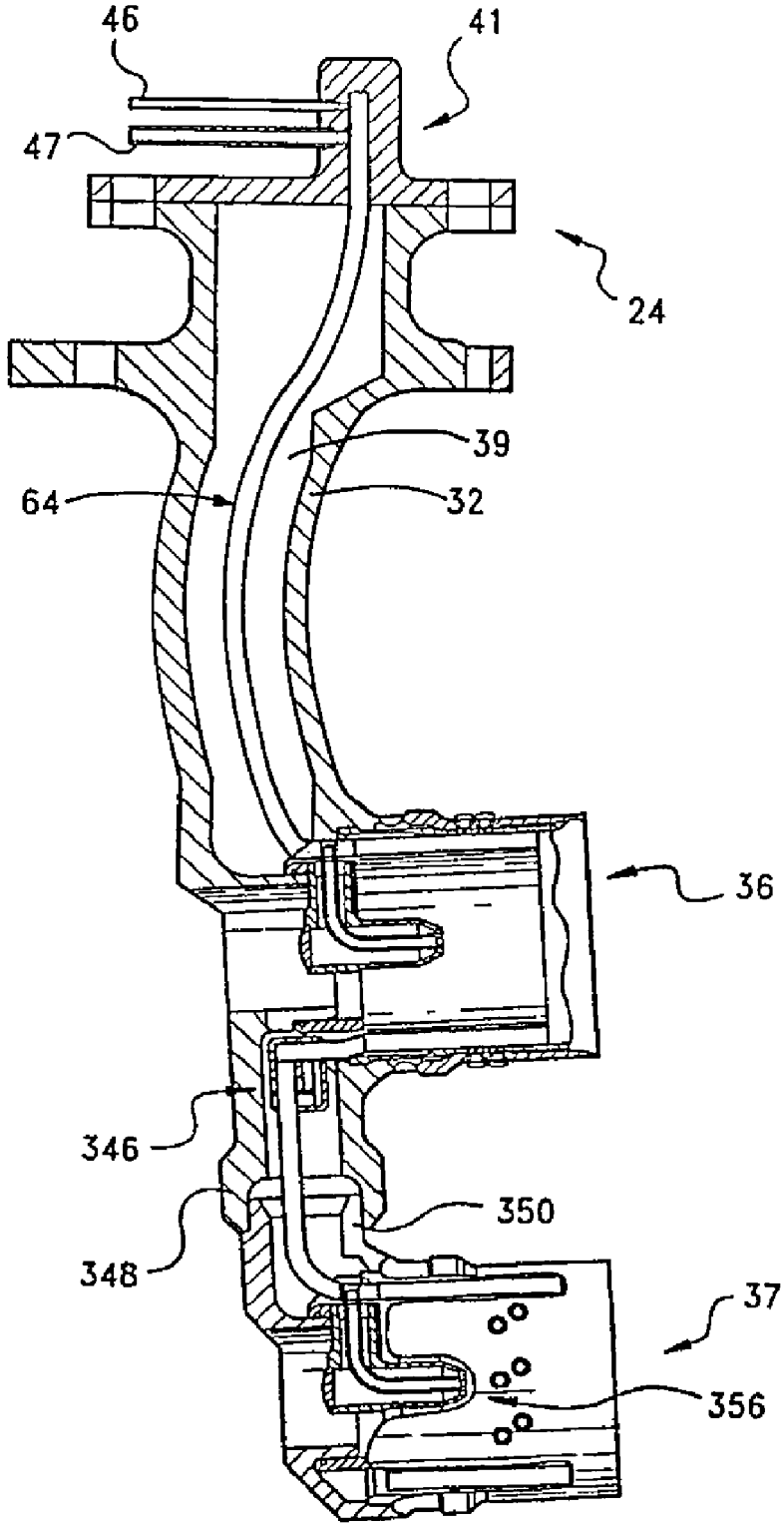
FIG. 4 is a cross-sectional view of a fuel injector in accordance with an exemplary embodiment of the invention.

Turning now to FIG. 4, an injector 24 in accordance with an exemplary embodiment of the present invention will be described. The injector 24 is substantially similar to the injector described above (FIG. 3) except that the stem 32 and fuel feed strip 64 are formed into a bow shape. The bow shape of the fuel feed strip generally corresponds to the shape of the first mode of vibration of a feed strip of a desired shape (e.g., a straight fuel feed strip) and, as will be described in detail below, results in an increase in the first resonant frequency of the fuel feed strip 64. The bow shape fuel feed strip 64 also exhibits increased flexibility in the axial direction that can compensate for expansion and contraction of the fuel feed strip 64 in response to thermal changes in the combustion chamber. Accordingly, the fuel feed 64 strip of FIG. 4 functions in a similar manner to the fuel feed strip 64 of FIGS. 1-3 except that the natural frequency of the fuel feed strip 64 is increased, preferably to a frequency above the highest anticipated driving frequency.

Figure 5:
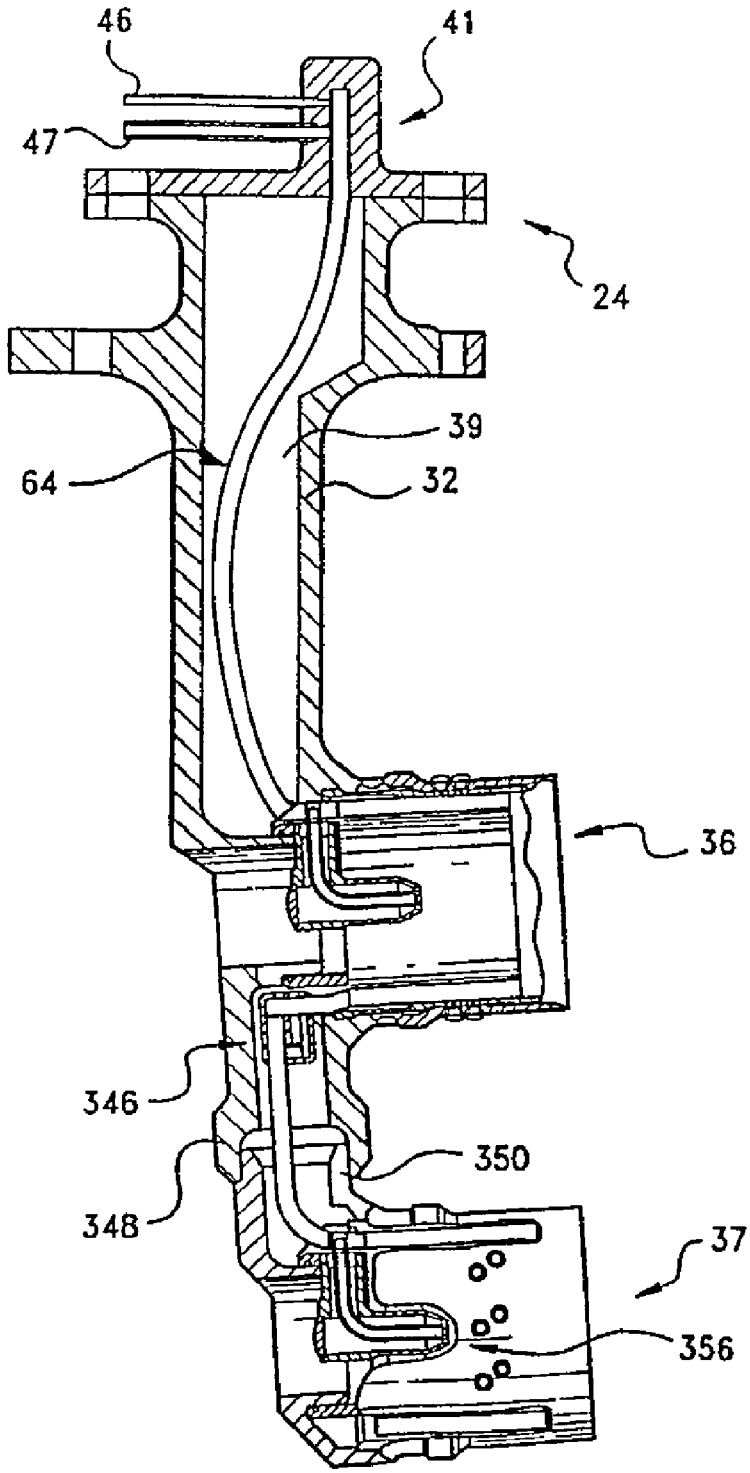
FIG. 5 is a cross-sectional view of a fuel injector in accordance with another exemplary embodiment of the invention.

In FIG. 5, another exemplary embodiment in accordance with the present invention is illustrated. In this embodiment the stem 32 is generally straight, like the injector 24 of FIGS. 1-3, but the fuel feed strip 64 is formed into a bow shape as in FIG. 4. As will now be described in detail, forming the fuel feed strip 64 into a bow shape generally corresponding to the shape of the first mode of vibration of a straight feed strip and results in an increase in the first resonant frequency of the fuel feed strip 64.

Forming a beam-like structure (e.g., fuel feed strip 64) such that its original shape is approximately the same as any given vibration mode shape normally experienced by a straight beam with the same cross-section and end conditions results in an increase in the resonant frequency and/or suppression of a resonant frequency of the beam-like structure without the aid of additional structure (e.g., stiffening ribs, wings, etc.). By way of example, a beam with an original shape resembling the first vibration mode shape of a straight beam with the same cross section and end conditions will have a first resonant frequency higher than the first resonant frequency of the straight beam and a first vibration mode shape different than the first vibration mode shape of the straight beam. Typically, the first vibration mode shape of the shaped beam will correspond to the second vibration mode shape of the straight beam.

The above-described phenomenon is illustrated in FIGS. 6 and 7. In FIG. 6, a beam 70 having an original shape that is straight (e.g., unshaped) is illustrated. The first vibration mode 72 of the straight beam 70 is generally in the shape of a bow. In FIG. 7, a beam 74 having an original shape generally corresponding to the first vibration mode shape 72 of the unshaped beam 70 of FIG. 6 is illustrated. The beam 74 in FIG. 7 has a different first vibration mode shape 76 corresponding to a higher frequency than the first resonant mode 72 of the straight beam 70. In general, the first vibration mode shape 76 generally corresponds to the second vibration mode shape of the straight beam 70.

It will be appreciated that higher vibration modes can also be suppressed in accordance with the invention. For example, a second vibration mode shape can be suppressed by forming the beam into a shape approximating the second vibration mode shape of an unshaped straight beam. It will be appreciated, however, that such a shaped beam will still exhibit the first vibration mode shape when exposed to a corresponding driving frequency. Suppressing a particular higher vibration mode shape can be advantageous in situations where the suppressed mode shape is associated with unacceptable stress levels in the component or part but the other mode shapes do not result in unacceptable stress levels.

It will be appreciated that the shaped beam need only approximate the vibration mode shape in order to achieve satisfactory results. As an example, one way in which to approximate the first vibration mode shape for any given length beam is by using the ratio of the offset O to beam length L (referred to as the offset ratio; see FIG. 4) of the vibration mode shape of an unshaped beam. Accordingly, once the offset ratio is determined for a given mode shape of an unshaped beam with a given cross-section and end conditions, a similar beam of any length can be shaped into a shape approximating this vibration mode shape by utilizing the offset ratio as a reference. As another example, a beam can be shaped into a shape approximating a given vibration mode shape and then analyzed (e.g., tested) to determine whether the desired resonant frequency is suppressed.

Returning to FIGS. 4 and 5, it will now be appreciated that a fuel injector is provided including a fuel feed strip 64 having an increased natural frequency and increased flexibility in the axial direction. The natural frequency of the fuel feed strip 64 is increased by suppressing a natural frequency mode through shaping of the fuel feed strip 64. The geometry of the fuel feed strip 64 dictates the shape and frequency of the lowest and subsequent modes it assumes and also whether the feed strip 64 will skip a certain mode. By increasing the natural frequency of the fuel feed strip 64, the potential for high-cycle fatigue failure can be reduced. The bow shape of the fuel feed strip 64 increases its axial flexibility (ability to tolerate axial loads) over an unshaped straight feed strip.

Figure 8:
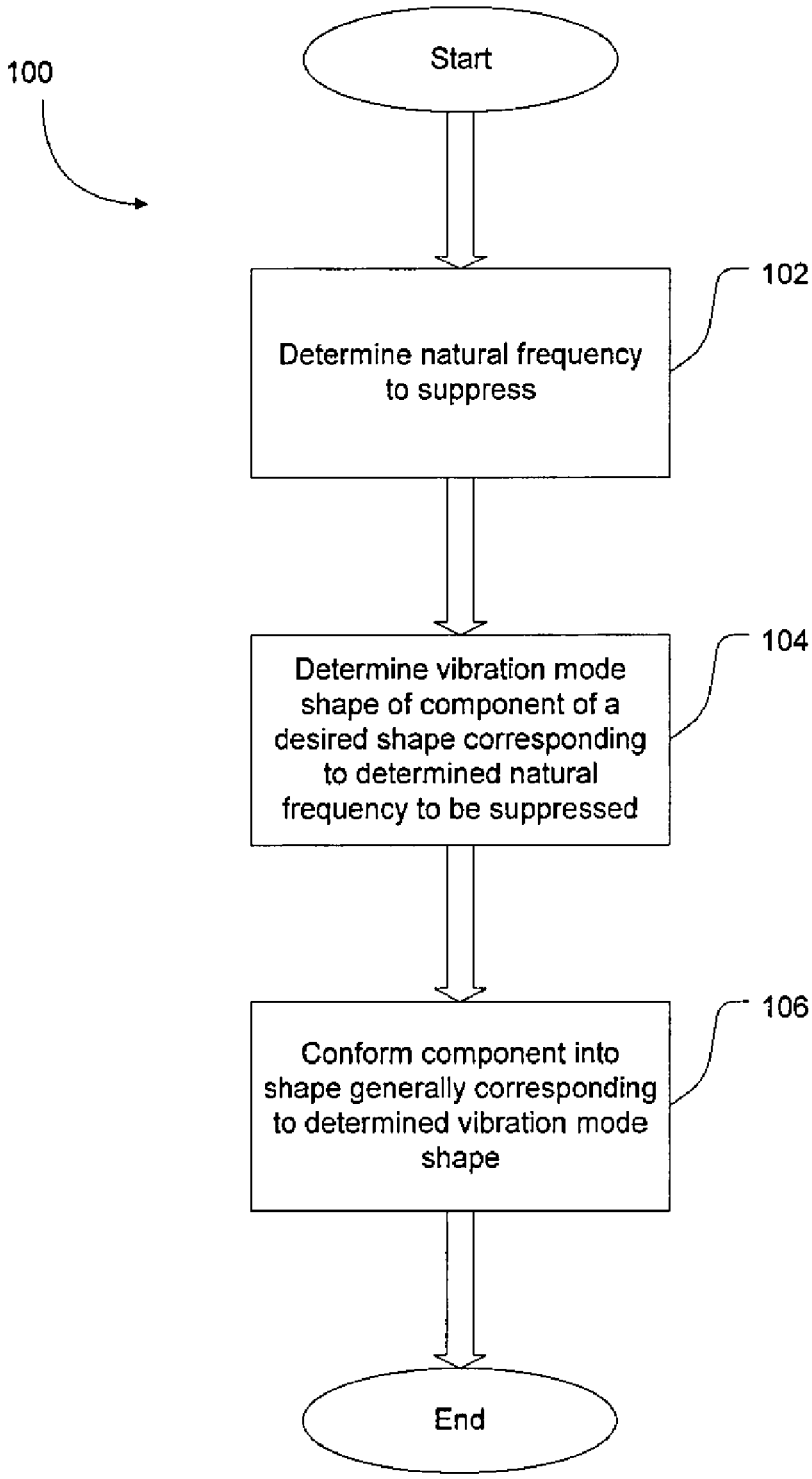
FIG. 8 is a flow chart illustrating a method in accordance with the present invention.

Turning to FIG. 8, a method 100 of suppressing a natural frequency of a component is illustrated. The method begins with method step 102 wherein the natural frequency to be suppressed is determined. This step can be carried out by analysis, such as testing, during operation of the turbine or other equipment. Alternatively, mathematical modeling (e.g., finite element analysis) can be used. In method step 104, a vibration mode shape of a component of a desired shape, such as a fuel feed strip of a desired shape, corresponding to the natural frequency to be suppressed is determined. The vibration mode shape can be determined in any suitable manner, such as by observation or mathematical analysis. In method step 106, the component is shaped into a shape generally corresponding to the determined vibration mode shape.

It will be appreciated that although the invention has been shown and described in the context of a fuel feed strip for a gas turbine engine, principles of the invention are applicable to other parts and components of gas turbine engines as well as other machinery where parts and components are subject to resonance and/or high-cycle fatigue.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of increasing a natural frequency of an elongate fuel passage of a fuel injector of a turbine comprising:

identifying a first natural frequency of the elongate fuel passage of a desired shape;

determining a vibration mode shape corresponding to the first natural frequency of the elongate fuel passage; and shaping the elongate fuel passage into a shape approximating the determined vibration mode shape;

whereby the first natural frequency of the shaped elongate fuel passage will generally correspond to a second natural frequency of the elongate fuel passage.

2. A method as set forth in claim 1, wherein the elongate fuel passage of a desired shape is a straight beam structure.

3. A method as set forth in claim 2, wherein the vibration mode shape is a bow shape corresponding to the first natural frequency of the straight beam-structure.

* * * * *